United States Patent [19]

Elias et al.

[11] Patent Number: 4,522,683

[45] Date of Patent: Jun. 11, 1985

[54] DISSOLUTION OF METALS UTILIZING TUNGSTEN-DIOL COMBINATIONS

[75] Inventors: Moenes L. Elias, Canfield; Walter L. Burger, Salem, both of Ohio

[73] Assignee: Plastic Specialties and Technologies, Inc., Barrington, Ill.

[21] Appl. No.: 570,056

[22] Filed: Jan. 12, 1984

[51] Int. Cl.[3] ..... C23F 1/00; B44C 1/22

[52] U.S. Cl. ..... 156/666; 156/659.1; 156/664; 252/79.2; 252/79.4

[58] Field of Search ..... 156/659.1, 664, 666; 252/79.2, 79.4

[56] References Cited

U.S. PATENT DOCUMENTS

| | | | |
|---|---|---|---|
| 3,945,865 | 3/1976 | Kamperman | 256/79.4 X |
| 4,130,455 | 12/1978 | Elias et al. | 156/666 |
| 4,140,646 | 2/1979 | Kent et al. | 156/666 X |
| 4,158,593 | 6/1979 | Allan et al. | 156/666 |
| 4,233,111 | 11/1980 | Valayil et al. | 156/666 |
| 4,233,113 | 11/1980 | Valayil et al. | 156/666 |

*Primary Examiner*—G. L. Kaplan
*Assistant Examiner*—Nam X. Nguyen
*Attorney, Agent, or Firm*—Wood, Herron & Evans

[57] ABSTRACT

Improved metal dissolution rates are obtained when using a solution containing sulfuric acid, hydrogen peroxide and combinations of catalytic amounts of tungsten and of certain diols.

21 Claims, No Drawings

DISSOLUTION OF METALS UTILIZING TUNGSTEN-DIOL COMBINATIONS

The present invention relates to the dissolution of metals in an aqueous bath containing sulfuric acid and hydrogen peroxide, and in particular to a novel bath composition capable of effecting the dissolution at high rates. In one specific aspect the invention is concerned with etching of copper in the production of printed circuit boards.

BACKGROUND OF THE INVENTION

As is well known in the art, in the manufacture of printed electronic circuits a laminate of copper and etch resistant material, usually plastic, is used. A common method of obtaining the circuits is to mask the desired pattern on the copper surface of the laminate with a protective resist material, which is impervious to the action of an etch solution. In a subsequent etching step, the unprotected areas of the copper are etched away, while the masked areas remain intact and provide the desired circuiting supported by the plastic. The resist material can be a plastic material, an ink or a solder.

In the last few years, the industry has more and more turned to hydrogen peroxide-sulfuric acid systems for etching the electronic circuit boards, due to the low cost of the etching solutions and to the relative ease with which copper values can be recovered from the spent etch solutions.

However, there are many problems connected with the use of hydrogen peroxide as an ingredient in the etchants. It is a well known fact that the stability of hydrogen peroxide in a sulfuric acid-hydrogen peroxide solution is detrimentally affected by the presence of heavy metal ions such as copper ions. Thus, as etching proceeds and copper ion content of the etchant thereby increases, the etch rate will experience a serious dropoff due to the decomposition of the hydrogen peroxide in the etch bath, which will soon be exhausted. In order to improve the capacity of these etchants, various stabilizers have been suggested and used with some success for abatement of the hydrogen peroxide decomposition due to the presence of copper ions.

Although considerable retardation of the metal ion-induced hydrogen peroxide decomposition can be achieved by the addition of a suitable stabilizer, the etch rates of the stabilized hydrogen peroxide-sulfuric acid etchants have, generally, been quite low and in need of improvement especially at high copper ion concentrations. It has therefore been suggested in the prior art to add a catalyst or promoter to improve the etch rate. Specific examples of such catalyst are the metal ions disclosed in U.S. Pat. No. 3,597,290, such as silver, mercury, palladium, gold and platinum ions, which all have a higher oxidation potential than that of copper. Other examples include those of U.S. Pat. No. 3,293,093 i.e. phenacetin, sulfathiazole and silver ion, or the various combinations of any of the above three components with dibasic acids, as disclosed in U.S. Pat. No. 3,341,384, or with the phenyl ureas or benzoic acids of U.S. Pat. No. 3,407,141, or with the urea and thiourea compounds of U.S. Pat. No. 3,668,131.

Another problem often encountered using hydrogen peroxide-sulfuric acid etchants is that etching rates are adversely effected by the presence of even small amounts of chloride or bromide ions, and usually ordinary tap water cannot be used in preparing the etching solution. It is, therefore, required that these ions be removed either by deionization of the water or by precipitation of the contaminating ions, e.g. with silver ions added in the form of a soluble silver salt.

Although silver ions thus appear to provide a universal solution to the above-discussed problem of low etch rates as well as that caused by the presence of free chloride and bromide ion content, there are still some disadvantages had with the use of silver ions in preparing hydrogen peroxide-sulfuric acid etch solutions. One of these is the high cost of silver. Another is that silver ions still do not promote the rate of etching as much as would be desired.

An object of the present invention is, therefore, to provide a novel, highly efficient aqueous composition for the dissolution of metals.

Another object is to provide an improved method for the dissolution of metals, e.g. copper or alloys of copper, at high rates.

Other objects of the invention will become readily apparent from the detailed description set forth hereinafter.

THE INVENTION

In accordance with the present invention there is provided a composition which comprises an aqueous solution of from about 0.2 to about 4.5 gram moles per liter of sulfuric acid, from about 0.25 to about 8 gram moles per liter of hydrogen peroxide and a synergistic combination of catalytically effective amounts of tungsten and of certain diols.

Significantly improved metal dissolution rates are obtained when the concentration of the catalyst combination is maintained at about 2 millimoles per liter and higher. Preferably, the concentration should be in the range from about 5 to about 50 millimoles per liter, although higher values can also be used. There is, however, no particular added advantage in using such excess quantities.

The components of the synergistic combination can be employed in the range of 0.1 to 10 percent by weight of diol and 5 to 5000 ppm of tungsten with the preferred range being from about 0.5 to 5 percent by weight of diol and 50 to 2000 ppm of tungsten based on the total metal dissolution composition. For achievement of optimum results, it has been found advantageous to employ 1 to 3 percent by weight of diol and 100 to 1000 ppm of tungsten.

The diols employed according to the present invention can be primary diols, such as 1,4-butanediol and 1,6-hexanediol. Suitable compounds for use are disclosed in U.S. Pat. No. 4,141,850 and in U.S. Pat. No. 4,174,253. Thus, there may be employed primary diol promoters having the general formula:

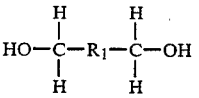

wherein $R_1$ is selected from: (a)—$(CR_2R_3)_n$—, where each $R_2$ and $R_3$ independently from each other is either hydrogen or an alkyl group of 1 to 4 carbon atoms, and n is at least 2, or (b) a cycloparaffinic group or an alkyl-substituted cycloparaffinic group having from 5 to 7 carbon atoms in the ring structure and from 1 to 4 carbon atoms in any of the alkyl substitutions.

Examples of suitable primary diol promoters useful in the present invention include 1,4-butanediol, 1,5-pentanediol, 1,6-hexanediol, 1,7-heptanediol, etc.; 2-methyl-1,4-butanediol, 2-ethyl-1,5-pentanediol, 3-propyl-1,5-pentanediol, etc.; 1,4-cyclohexanedimethanol, 2-methyl-1,3-cyclopentanedimethanol, etc.

There can also be employed (a) monohydroxy or dihydroxy-substituted cycloparaffins containing from 5 to 7 carbon atoms in the ring structure, or (b) monohydroxy or dihydroxy-substituted alkylcycloparaffins containing from 5 to 7 carbon atoms in the ring structure, where each of the alkyl groups contains from 1 to 4 carbon atoms and is attached to an unsubstituted carbon atom in the ring structure.

Suitable hydroxy-substituted cycloparaffins useful in the invention are cyclopentanol, cyclohexanol, cycloheptanol, 1,2-cyclopentanediol, 1,3-cyclopentanediol, 1,2-cyclohexanediol, 1,3-cyclohexanediol, 1,4-cyclohexanediol, 1,2-cycloheptanediol, 1,3-cycloheptanediol, 1,4-cycloheptanediol as well as various other alcohols and diols of $C_5$–$C_7$ alkyl-substituted cycloparaffins such as the methylcyclohexanols. The preferred compounds of this type are those which have no alkyl substitutions in the ring structure.

A second type of diol can also be employed. This type of compound is disclosed in copending U.S. patent application Ser. No. 525,078, filed Aug. 22, 1983. These diol promoters have the general formula:

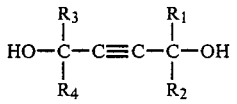

where $R_1$, $R_2$, $R_3$ and $R_4$ can be either H, $CH_3$, $OC_2H_5$ or $OC_3H_8$.

Examples of suitable diol promoters useful in the present invention include 2 butyne-1,4-diol; 3 hexyne-2,5-diol; monopropoxylated 2 butyne-1,4 diol; and diethoxylated 2 butyne-1,4-diol.

The use of tungsten as a sole promoter is disclosed in copending U.S. patent application Ser. No. 525,079, filed Aug. 22, 1983.

Neither of the copending patent applications referred to above suggest that the promoters they disclose could be employed together, much less that their conjoint use would provide significant and marked improvement over the results realized through their individual use.

The sulfuric acid concentration of the solution should be maintained between about 0.2 to about 4.5 gram moles per liter and preferably between about 0.3 and 4 gram moles per liter. The hydrogen peroxide concentration of the solution should broadly be in the range of from about 0.25 to about 8 gram moles per liter and preferably limited to 1 to about 4 gram moles per liter.

The remaining portion of the solution is made up with water which does not need any special pretreatment to remove free chloride and bromide ions to the conventional level of 2 ppm or less. Nor is it necessary to add any compounds such as a soluble silver salt to the solution in order to precipitate the chloride and bromide contaminants otherwise harmful to the etching process. It has been found that the compositions of this invention can contain relatively large amounts of the contaminants, such as 50 ppm and even higher, without any noticeable deleterious effect on etch rates.

The solutions may also contain other various ingredients such as any of the well known stabilizers used for counteracting heavy metal ion induced degradation of hydrogen peroxide. Examples of suitable stabilizers include those disclosed in U.S. Pat. No. 3,537,895; U.S. Pat. No. 3,597,290; U.S. Pat. No. 3,649,194; U.S. Pat. No. 3,801,512 and U.S. Pat. No. 3,945,865. The aforementioned patents are incorporated in this specification by reference. Of course, any of various other compounds having a stabilizing effect on acidified hydrogen-peroxide metal treating solutions can be used with equal advantage.

Also, any of the additives known to prevent undercutting, i.e. side or lateral etching, can also be added, if desired. Examples of such compounds are the nitrogen compounds disclosed in U.S. Pat. Nos. 3,597,290 and 3,773,577, both incorporated in this disclosure by reference. However, in the present invention the use of such additives is not necessary because of the rapid etch rates obtained due to inclusion of the tungsten catalyst in the etching compositions.

The solutions are particularly useful in the chemical milling and etching of copper and alloys of copper, but other metals and alloys may also be dissolved with the solutions of this invention, e.g. iron, nickel, zinc and steel.

When using the solutions to dissolve a metal, conventional operating conditions for the particular metal are employed. Thus, in the etching of copper usually temperatures between about 105° to about 140° F. should be maintained and preferably the operating temperature should be between about 120° and about 135° F.

The solutions are eminently suited as etchants using either immersion or spray etching techniques. The etch rates obtained with the compositions of the invention are extremely fast, e.g. etch times in the order of about 0.5 to 1 minute are typical when etching copper laminates containing 1 oz. copper per square foot. Because of these unusually high etch rates the compositions are especially attractive as etchants in the manufacture of printed circuit boards, where it is required that a relatively large number of work pieces be processed per unit time for economical reasons as well as for minimizing detrimental lateral etching or undercutting of the edges under the resist material. Another important advantage of the invention is that clean etchings are achieved.

The following examples are provided as illustration of the invention.

EXAMPLES 1–19

In this set of comparative experiments copper clad laminates (2×3 inches) having a coating of 1 ounce copper per square foot were immersion etched in stirred solutions (300 ml) maintained at 120° F. Each of the solutions contained 10 volume percent 66° Baume sulfuric acid (1.8 gram moles/liter), 10 volume percent (50% w/w) hydrogen peroxide (1.76 gram moles/liter), 11.8 oz/gal. of cupric sulfate pentahydrate with the balance being either deionized or distilled water. The solutions were stabilized with 2.5 grams/liter sodium phenolsulfonate. Without any catalyst and added chloride ions (Example 1) the time required to completely remove the copper from the bottom side of a laminate was 9 minutes and 15 seconds.

The etch solutions of Examples 2–19 had the same compositions as that of Example 1, except that they also contained diol and/or tungsten promoters as shown in Table I. The results of the etching tests showed that all of the additives had a dramatic effect in improving the etch rates.

TABLE I

| Ex. No. | Organic Additive | Organic Additive Concentration (% by Weight) | Concentration of Tungsten (ppm) | Etch Rate (min:sec) |
|---|---|---|---|---|
| 2 | 1,6-hexanediol | 0.75 | — | 7:30 |
| 3 | — | — | 100 | 7:30 |
| 4 | 1,6-hexanediol | 0.75 | 100 | 5:55 |
| 5 | — | — | 775 | 4:10 |
| 6 | 1,6-hexanediol | 0.75 | 775 | 4:45 |
| 7 | — | — | — | 9:15 |
| 8 | Monopropoxylated 2-butyne-1,4-diol | 1.0 | — | 9:03 |
| 9 | Monopropoxylated 2-butyne-1,4-diol | 3.0 | — | 11:24 |
| 10 | 3-hexyne-2,5-diol | 1.0 | — | 8:47 |
| 11 | 3-hexyne-2,5-diol | 3.0 | — | 8:31 |
| 12 | Diethoxylated 2-butyne-1,4-diol | 1.0 | — | 10:23 |
| 13 | Diethoxylated 2-butyne-1,4-diol | 3.0 | — | 14:21 |
| 14 | Monopropoxylated 2-butyne-1,4-diol | 1.0 | 775 | 5:15 |
| 15 | 3-hexyne-2,5-diol | 1.0 | 775 | 3:54 |
| 16 | Diethoxylated 2-butyne-1,4-diol | 1.0 | 775 | 4:33 |
| 17 | — | — | 100 | 6:40 |
| 18 | 1,4-butanediol | .75 | 100 | 5:00 |
| 19 | 1,4-butanediol | .75 | — | 5:45 |

EXAMPLES 20–25

A second series of tests were run using butynediol and tungsten. All of the bath parameters were the same except that there was employed 4 g/l of sodium phenol sulfonate rather than 2 g/l.

TABLE II

| Ex. No. | Butynediol Concentration (% by Weight) | Tungsten Concentration (ppm) | Etch Rate (min:sec) |
|---|---|---|---|
| 20 | — | — | 10:39 |
| 21 | — | 100 | 8:44 |
| 22 | — | 775 | 6:40 |
| 23 | 1.0 | — | 10:22 |
| 24 | 1.0 | 100 | 7:00 |
| 25 | 1.0 | 775 | 3:45 |

As can be seen by the test results in the foregoing Examples 2–25, a combination of tungsten and the organic additives tested provides improvement in the etch rate when compared to etch rates obtained when either the tungsten or organic additive is used by itself.

What is claimed is:

1. In a process for the dissolution of metal in which a metal is contacted with an aqueous solution containing from about 0.2 to about 4.5 gram moles per liter of sulfuric acid and from about 0.25 to about 8 gram moles per liter of hydrogen peroxide, the method of increasing the metal dissolution rate of the solution, which method comprises adding an effective amount of a promoter composition comprising from about 5 to about 5000 parts per million of tungsten and from about 0.1 to 10% by weight of a diol selected from the group consisting of a primary diol having the general formula:

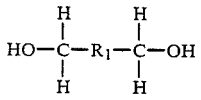

wherein $R_1$ is selected from: (a)—$(CR_2R_3)_n$—, where each $R_2$ and $R_3$ independently from each other is either hydrogen or an alkyl group of 1 to 4 carbon atoms, and n is at least 2, (b) a cycloparaffinic group or an alkyl-substituted cycloparaffinic group having from 5 to 7 carbon atoms in the ring structure and from 1 to 4 carbon atoms in any of the alkyl substitutions, (c) monohydroxy or dihydroxy-substituted cycloparaffins containing from 5 to 7 carbon atoms in the ring structure, and (d) monohydroxy or dihydroxy-substituted alkylcycloparaffins containing from 5 to 7 carbon atoms in the ring structure, where each of the alkyl groups contains from 1 to 4 carbon atoms and is attached to an unsubstituted carbon atom in the ring structure, and (e) a diol of the general formula:

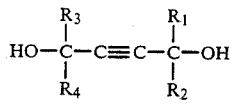

wherein $R_1$, $R_2$, $R_3$ and $R_4$ can be either H, $CH_3$, $OC_2H_5$ or $OC_3H_8$.

2. The method of claim 1 wherein the tungsten is employed in the amount of from 5 to 5000 parts per million and the diol is employed in the amount of from about 0.5 to about 5.0% by weight.

3. The method of claim 1 wherein the aqueous solution contains sodium phenolsulfonate as a stabilizer to reduce the degrading effect of heavy metal ions on hydrogen peroxide.

4. The method of claim 1 wherein the hydrogen peroxide concentration is maintained between about 1 and about 4 gram moles per liter.

5. The method of claim 1 wherein the sulfuric acid concentration is maintained between about 0.3 and about 4 gram moles per liter.

6. The method of claim 1 wherein the promoter is 1,4-butanediol.

7. The method of claim 1 wherein the promoter is 1,6-hexanediol.

8. The method of claim 1 wherein the promoter is 2-butyne-1,4-diol.

9. The method of claim 1 wherein the promoter is 3-hexyne-1,4-diol.

10. The method of claim 1 wherein the promoter is monopropoxylated 2-butyne-1,4-diol.

11. The method of claim 1 wherein the metal is copper or an alloy of copper.

12. In a composition for metal dissolution comprising an aqueous solution of from about 0.2 to about 4.5 gram moles per liter of sulfuric acid and from about 0.25 to about 8 gram moles per liter of hydrogen peroxide, the presence of an effective amount of a promoter composition comprising from about 5 to about 5000 parts per million of tungsten and from about 0.1 to 10% by weight of a diol selected from the group consisting of a primary diol having the general formula:

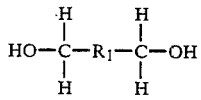

wherein $R_1$ is selected from: (a)—$(CR_2R_3)_n$—, where each $R_2$ and $R_3$ independently from each other is either hydrogen or an alkyl group of 1 to 4 carbon atoms, and n is at least 2, (b) a cycloparaffinic group or an alkyl-substituted cycloparaffinic group having from 5 to 7 carbon atoms in the ring structure and from 1 to 4 carbon atoms in any of the alkyl substitutions, (c) monohydroxy or dihydroxy-substituted cycloparaffins containing from 5 to 7 carbon atoms in the ring structure, and (d) monohydroxy or dihydroxy-substituted alkylcycloparaffins containing from 5 to 7 carbon atoms in the ring structure, where each of the alkyl groups contains from 1 to 4 carbon atoms and is attached to an unsubstituted carbon atom in the ring structure, and a diol of the general formula:

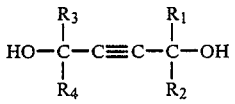

wherein $R_1$, $R_2$, $R_3$ and $R_4$ can be either H, $CH_3$, $OC_2H_5$ or $OC_3H_8$.

13. The composition of claim 12, wherein the tungsten is employed in the amount of from 5 to 5000 parts per million and the diol is employed in the amount of from about 0.5 to about 5.0% by weight.

14. The composition of claim 12 additionally containing sodium phenolsulfonate as a stabilizer for reducing the degrading effect of heavy metal ions on hydrogen peroxide.

15. The composition of claim 12 wherein the hydrogen peroxide concentration is maintained between about 1 and about 4 gram moles per liter.

16. The composition of claim 12 wherein the sulfuric acid concentration is maintained between about 0.3 and about 4 gram moles per liter.

17. The composition of claim 12 wherein the promoter is 1,4-butanediol.

18. The composition of claim 12 wherein the promoter is 1,6-hexanediol.

19. The composition of claim 12 wherein the promoter is 2-butyne-1,4-diol.

20. The composition of claim 12 wherein the promoter is 3-hexyne-1,4-diol.

21. The composition of claim 12 wherein the promoter is monopropoxylated 2-butyne-1,4-diol.

* * * * *